United States Patent [19]

Hotta

[11] Patent Number: 4,619,108

[45] Date of Patent: Oct. 28, 1986

[54] MULTIPLE STRAND TWINES COMPRISING MONOFILAMENTS AND MULTIPLE FILAMENTS, AND FISHNETS FORMED THEREOF

[75] Inventor: Keiji Hotta, Mie, Japan

[73] Assignee: Amikan Fishing Net Mfg. Co., Ltd., Yokkaichi, Japan

[21] Appl. No.: 725,271

[22] Filed: Apr. 19, 1985

[51] Int. Cl.[4] ..... D04G 1/00; D02G 3/02; D02G 3/38

[52] U.S. Cl. ..... 57/236; 57/238; 57/244; 87/12

[58] Field of Search ..... 57/236, 237, 238, 243, 57/244, 248, 249, 240; 87/12

[56] References Cited

U.S. PATENT DOCUMENTS

| | | | |
|---|---|---|---|
| 1,897,224 | 2/1933 | Andrews | 87/12 X |
| 2,225,290 | 12/1940 | Aibel et al. | 57/238 X |
| 2,971,321 | 2/1961 | Himmelfarb et al. | 57/237 |
| 3,291,897 | 12/1966 | Bramley | 57/237 X |
| 3,329,061 | 7/1967 | Momoi | 87/12 |
| 3,419,059 | 12/1968 | Bridge | 57/238 X |
| 3,590,570 | 7/1971 | Okuhashi et al. | 57/238 |
| 4,466,331 | 8/1984 | Matheson | 87/12 |

*Primary Examiner*—Billy S. Taylor
*Assistant Examiner*—Joseph J. Hail, III
*Attorney, Agent, or Firm*—Armstrong, Nikaido, Marmelstein & Kubovcik

[57] ABSTRACT

A multiple strand twine formed of a plural of monofilaments and multiple filaments wherein a multiple strand formed by undertwisting monofilament along with a plural of the multiple filaments is combined with a monostrand formed by twisting one monofilament alone in the same direction of the undertwisting, the combination of the both strands being then overtwisted in the direction opposite to the undertwisting. And a fish net formed of the above twines.

4 Claims, 2 Drawing Figures

MULTIPLE STRAND TWINES COMPRISING MONOFILAMENTS AND MULTIPLE FILAMENTS, AND FISHNETS FORMED THEREOF

BACKGROUND OF THE INVENTION

1. Field of the Invention

The present invention relates to multiple strand twines comprising monofilaments and multiple filaments and fishnets produced therewith.

For example the present invention relates to multiple strand twines and fishnets formed of the multiple strand twines which find particularly advantageous use in the Alaskan fisheries where governmental regulations require that fishnets formed of synthetic twines have at least thirty (30) strands or filaments; but, wherein such multiple strand twines have heretofore commonly been formed of a plurality of equal diameter filaments, and, consequently, the resulting fishnets do not possess the desired characteristics of transparency or invisibility in water which is a requisite characterstic of such nets. Therefore, multiple strand twines and fishnets formed therewith have been eagerly desired which meet filament requirement established for the Alaskan fisheries and which possess the characteristics of transparency and invisibility in water.

2. Description of the Prior Art

It is usually required that twines for fishnets meet the characteristics of transparency and invisibility in water and are further characterized by (a) high flexibility, (b) possessing knots which are compact, stable and less prone to loosening, and (c) the ease and efficiency with which knots can be formed. The fishnets employed, for example, in the Alaskan fisheries are additionally required to use synthetic twines formed of at least thirty (30) strands or filaments. Inventions have heretofore been proposed to meet the afore-mentioned characteristics and conditions. For example, in U.S. Pat. No. 3,329,061, the patentee describes a twine comprising seven (7) strands, a twisted centercore formed of a plurality of 210 denier synthetic filaments, and six (6) external strands or filaments wrapped thereabout. While such multiple strand twines thus constructed do serve to meet the requirements in the Alaskan fisheries, they are relatively thick for the required strength because the strands about the centercore are shorter than the surrounding strands. For this reason, they do not serve to optimize the strength, transparency, and invisibility in water.

In U.S. Pat. No. 4,466,331 as a second example, the patentee describes a twine construction produced by twisting at least one strand formed by undertwisting a plurality of synthetic multiple filaments together with strands formed of monofilaments in the same twisting direction of the above. Although the multiple strand twines have eliminated the afore-mentioned disadvantages, they have unstable torque and a possibility of producing twist irregularities because they are formed of twisted multiple filament strands and untwisted monofilament strands. When relatively thicker monofilaments are compared with relatively finer multiple filaments, the latter are more readily separated from the twines due to the differences in their bending resistances, thus making the twine surfaces rough. Accordingly, the multiple filaments cannot constitute fishnets which form easy and efficient knots.

SUMMARY OF THE INVENTION

In order to solve the afore-mentioned, conventional disadvantages, multiple strand twines formed of monofilaments and multiple filaments and fishnets formed thereof are disclosed. The twines are furnished with characteristics such as transpatency, invisibility in water, strength, flexibility, uniform twists, surface smoothness, reasonable knot-formability in the production of fishnets, the twines are also furnished with characteristics such as knot strength, reasonable spreadability in water, easy repairability, and easy operability when applied to fishnets, while, at the same time, meeting the minimum 30 strands or filaments requirement established, for example, for the Alaskan fisheries. More particularly, the multiple strand twines are composed of multiple strands formed by undertwisting one monofilament in combination with multifilaments and monostrands formed by twisting one monofilament alone in the above twisting direction the resulted multiple strand twines being overtwisted in the direction opposite to the above undertwisting.

Accordingly, the twines have not only satisfactory characteristies of transparency, invisibility in water, strength and flexibility but also stable torque sufficient to prevent ununiform twists from developing, further preventing the surface smoothness from being impaired by the separation of the multiple filaments therefrom, so that the knot formability can be improved in the production of fishnets. The fishnets formed of the multiple strand twines, in which the multiple filaments act as a cushion, ensure enhanced knot strength; reasonable spreadability in water because of their uniform twists; easy repairability in the case of their damage during fishing operation; and easy operability in the fisheries. That is, fish caught in the net can be more easily removed from the net due to its satisfactory flexibility, uniform twists, and smoothness on the surfaces of the twine. The fishnets can be easily suited for regulations established for the Alaskan fisheries by adjusting the numbers of the above-mentioned multiple filaments and monofilaments to a total of 30 or more.

It is a general aim of the present invention to solve the afore-mentioned, conventional problems. It is an object of the present invention to provide a multiple strand twine without any ununiform twist and with surface smoothness and satisfactory knot formability while ensuring conventional advantages characterized by transparency, invisibility in water strength and flexibility.

It is another object of the present invention to provide a fishnet using the twines thereby insuring satisfactory knot strength, spreadability in water, easy repairability, and easy operability during fishing as well as serviceability for example in the Alaskan fisheries.

BRIEF DESCRIPTION OF THE DRAWINGS

The embodiments of this invention is illustrated in the drawings.

DESCRIPTION OF THE PREFERRED EMBODIMENTS

Figure 1:
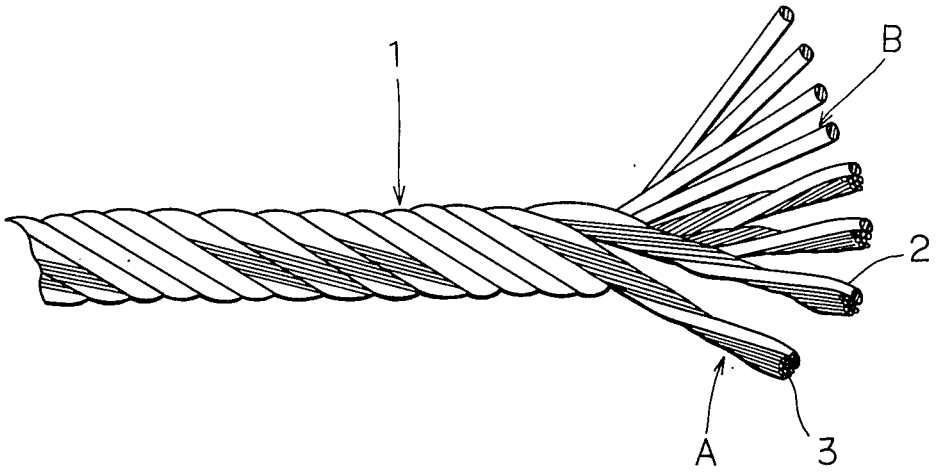
FIG. 1 is a perspective view showing multiple strand twines.
Figure 2:
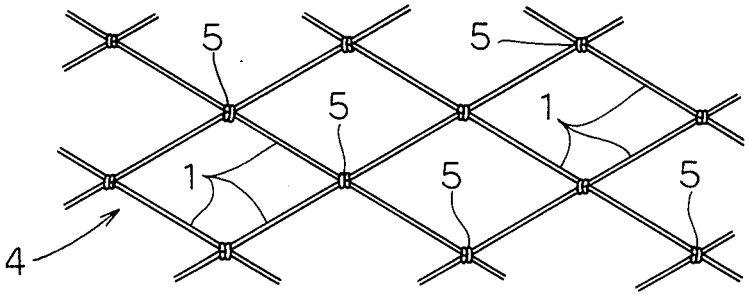
FIG. 2 is a plan view showing a fishnet.

The preferred embodiments of the present invention will be described in detail.

The multiple strand twine formed of a monofilament and a multiple filament is constructed in the following way.

One monofilament 2, for example No. 1.5 (about 315 deniers), formed of a synthetic resin such as nylon is undertwisted along with smaller diameter multiple filaments 3 consisting, for example, of seven 30—denier filaments (total 210 deniers) formed of the same material as the monofilament 2 with a "S" twist to form a twisted multiple strand "A". In addition to the above, another filament formed of the same material as the monofilament 2 is singly undertwisted with a "S" twist to form a twisted monostrand "B". Thereafter, a first plurality, for example four (4), of the multiple strands "A" are overtwisted with a second plurality, for example four (4), of the monostrands "B" with an "Z" twist to form a multiple strand twine 1.

In this case, the number of filaments in the multiple strand "A" is $(1+7)\times 4$, whereas the number of filaments in the monostrand "B" is $1\times 4$. Consequently, the multiple strand twine 1 is formed of a total of more than 30 filaments thereby meeting the requirements for fishnets used in the Alaskan fisheries.

There are diverse combinations of the number of the multiple strands "A" with that of the monostrands "B" and increased number of the multiple filaments 3 in the multiple strand "A" may cause a marked increase in the number of combination. For this reason, the manufacturer may form the twine according to the purpose and application.

The respective strands of the twine thus formed reduce the differences in softness between the monofilaments and the multiple filaments. Because the twisting direction in the formation of each multiple strand is opposite to that in the formation of the twine, the twine is finally provided with a stable and smooth surface. Accordingly, the twine in the present invention is most suited for imparting normal conditions to the fishnet.

Also, when a fishnet 4 is formed of the multiple strand twines, it is easy to form a fishnet by using knots 5 such as English knots or Double English knots.

What is claimed is:

1. A multiple strand synthetic resin twisted twine comprising, (a) a multiple strand of a plurality of multiple filaments of a synthetic resin and a monofilament of said synthetic resin twisted together in a first direction;

(b) at least one monostrand of one monofilament of said synthetic resin twisted alone in said first direction;

said first direction twisted multiple strand and said at least one monostrand twisted alone in said first direction being combined and over twisted together in a second direction opposite to said first direction.

2. A multiple strand synthetic resin twisted twine, as recited in claim 1, in which said synthetic resin is transparent.

3. A fishnet comprising a plurality of multiple strand synthetic resin twisted twines intersecting and interconnected at said intersections by knots, said multiple strand twisted twines each comprising, (a) a multiple strand of a plurality of multiple filaments of a synthetic resin and a monofilament of said synthetic resin twisted together in a first direction;

(b) at least one monostrand of one monofilament of said synthetic resin twisted alone in said first direction; said first direction twisted multiple strand and said at least one monostrand twisted alone in said first direction being combined and over twisted together in a second direction opposite to said first direction.

4. A fishnet, as recited in claim 3, in which said synthetic resin is transparent.

* * * * *